US005359398A

United States Patent [19]

Echigo et al.

[11] Patent Number: 5,359,398

[45] Date of Patent: Oct. 25, 1994

[54] ELECTROPHOTOGRAPHIC COPIER WITH A DEVELOPING DEVICE USING A LIQUID DEVELOPER

[75] Inventors: Katsuhiro Echigo, Yokohama; Ichiro Tsuruoka, Tokyo; Manabu Mochizuki, Yokohama; Tsuneo Kurotori, Tokyo; Kenzo Ariyama, Yokohama; Kenji Kojima; Mayumi Miyao, both of Tokyo; Hiroshi Tanabe, Kawasaki; Minoru Iwamoto, Yokohama, all of Japan

[73] Assignee: Ricoh Company, Ltd., Tokyo, Japan

[21] Appl. No.: 969,501

[22] Filed: Oct. 30, 1992

Related U.S. Application Data

[63] Continuation of Ser. No. 610,781, Nov. 8, 1990, abandoned.

[30] Foreign Application Priority Data

Nov. 9, 1989 [JP] Japan ..... 1-289999
Dec. 15, 1989 [JP] Japan ..... 1-325473

[51] Int. Cl.[5] ..... G03G 15/10; G03G 21/00

[52] U.S. Cl. ..... 355/256; 118/652; 118/659; 355/208; 355/246; 355/307; 430/116

[58] Field of Search ..... 355/256, 208, 245, 246, 355/307, 327, 284; 118/659, 652, 660, 696; 430/116

[56] References Cited

U.S. PATENT DOCUMENTS

| | | | |
|---|---|---|---|
| 3,748,035 | 7/1973 | Mannik | 355/327 X |
| 4,165,172 | 8/1979 | Okamoto et al. | 355/307 X |
| 4,315,685 | 2/1982 | Inuzuka et al. | 355/208 X |
| 4,515,466 | 5/1985 | Heisler | 355/384 |
| 4,720,731 | 1/1988 | Suzuki et al. | 355/256 X |
| 4,985,733 | 1/1991 | Kurotori et al. | 355/256 X |

FOREIGN PATENT DOCUMENTS

| | | | |
|---|---|---|---|
| 58-79276 | 5/1983 | Japan | 355/307 |
| 58-192037 | 11/1983 | Japan . | |
| 59-124359 | 7/1984 | Japan | 355/246 |

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

An image forming apparatus which uses a liquid developer to produce a visible image from an image carrier is provided with a movable cleaning unit. This movable cleaning unit is moved in and out of contact with the image carrier. A tank stores the liquid developer which is fed to both the developing unit and to the cleaning unit and is provided with a mechanism for feeding the developing unit and the cleaning unit with the liquid developer which is so stored.

7 Claims, 11 Drawing Sheets

ELECTROPHOTOGRAPHIC COPIER WITH A DEVELOPING DEVICE USING A LIQUID DEVELOPER

This application is a continuation of application Ser. No. 07/610,781, filed on Nov. 8, 1990, now abandoned.

BACKGROUND OF THE INVENTION

The present invention relates to an electrophotographic copier having a developing device of the type using a liquid developer and, more particularly, to an electrophotographic copier capable of starting on an operation immediately even when left unused over a long period of time.

Conventional electrophotographic copiers include one which has an image carrier in the form of a photoconductive element and a developing device of the type using a liquid developer for developing a latent image electrostatically formed on the image carrier. The liquid developer consists of a solvent or carrier implemented with oil-based aliphatic hydrocarbon, and a condensed toner dispersed in the carrier and made up of a coloring agent, resin, and some additive. Examples of such a carrier are Isopar E, G, H, L, K and M (available from Esso), and Shellzole 71 and Solvesso 150 (available from Shell) which have desirable toner dispersibility, developing characteristic, and fixing characteristic. Other carriers for the above application include cyclohexane, n-hexane, n-heptane, n-nonane, n-octane, isooctane, isododecane, and ligroine. When this kind of liquid developer, i.e. , a dispersion of a toner in a carrier is used to develop a latent image electrostatically formed on the drum, some of the liquid remains on the drum after the development. Usually, the liquid so remaining on the drum is removed by a cleaning device which is located in close proximity to the drum. The cleaning device has a cleaning roller contacting the surface of the drum and supplied with the liquid from a tank, and a cleaning blade contacting the surface of the drum at the free end thereof. The cleaning roller is rotated and held in contact with the rotating drum to remove most of the toner remaining on the drum, while the cleaning blade removes the toner which the roller has failed to remove.

On completing the above-mentioned cleaning operation, the cleaning roller and cleaning blade are released from the surface of the drum in synchronism with the stop of rotation of the drum. At this instant, some liquid developer is left between the cleaning roller and cleaning blade and the drum. In general, the carriers constituted by oil-based aliphatic hydrocarbon are highly volatile. Hence, when the copier is not used over a long period of time after the cleaning operation, the carrier of the developer left on the drum volatilizes with the result that only the toner remains on and adheres to the drum due to drying. It has been customary to cope with this problem by the combination of a preheat mode and a precleaning procedure. Specifically, when the copier ended its operation is left unused after the stop of the drum and the stop of the developer supply from the tank to the developing and cleaning devices, it is caused into a preheat mode on the lapse of a predetermined period of time. Then, in the event of the next copying operation, the preheat mode is cancelled, and the liquid developer is again fed from the tank to the developing and cleaning devices to preclean the surface of the drum. During the precleaning, the cleaning roller and cleaning blade of the cleaning device are held in contact with the drum to remove the toner dried and adhered to the surface of the drum. Such precleaning usually continues about 30 seconds with the result that at least about 30 seconds is simply wasted until the copier becomes actually operable in the event of the next copying operation. This retards the time when the copier can start on an actual copying operation and thereby critically lowers the productivity of copies.

The liquid developer contains a carrier having high volatility, as stated earlier. Hence, when the copier is not used over a long period of time, the carrier volatilizes not only on the surface of the drum but also inside of the the developing and cleaning devices. Then, only the toner deposits or solidifies in the devices to form sludge, failing to have an acceptable dispersed condition in the carrier. Images developed by such a liquid developer would have white stripes, black dots and other defects while suffering from an irregular density distribution. The previously stated precleaning eliminates this problem. Specifically, by the precleaning, the liquid in the tank is stirred to maintain the toner in a good dispersed condition in the carrier. This liquid is fed from the tank to the developing and cleaning devices to set up the desirable dispersed condition of the toner in such devices also, preventing the liquid with deposited or solidified toner from being used for development. The precleaning, however, has a drawback that it wastefully consumes about 30 seconds and, therefore, prevents the copier to start on a copying operation immediately.

SUMMARY OF THE INVENTION

It is therefore an object of the present invention to provide an electrophotographic copier of the type described which is capable of starting on a copying operation without any waiting time even when left unused over long period of time, thereby enhancing the productivity of copies.

It is another object of the present invention to provide an elctrophotographic copier of the type described which while left unused over a long time performs periodic postcleaning to thereby eliminate the need for precleaning.

In accordance with the present invention, image forming equipment comprises an image carrier for electrostatically forming a latent image on the surface thereof which moves, a developing unit for developing the latent image by a liquid developer to produce a visible image, an image transferring unit for transferring the visible image to a recording medium, a cleaning unit for cleaning the surface of the image carrier after image transfer, a tank storing the liquid developer to be fed to the developing unit and cleaning unit, a feeding device for feeding the liquid developer from the tank to the developing unit and cleaning unit, and a controller for controlling the feeding device such that the liquid developer is fed to the developing unit and cleaning unit at a predetermined timing. The liquid developer consists of a carrier having a siloxane structure and a toner dispersed in the carrier.

Also, in accordance with the present invention, an image forming equipment comprises an image carrier for electrostatically forming a latent image on the surface thereof which moves, a developing unit for developing the latent image by a liquid developer to produce a visible image, an image transferring unit for transferring the visible image to a recording medium, a cleaning unit for cleaning the surface of the image carrier after image transfer, a tank storing the liquid developer to be fed to the developing unit and cleaning unit, a feeding device for feeding the liquid developer from the tank to the developing unit and cleaning unit, and a controller for controlling the feeding means such that the liquid developer is fed to the developing unit and cleaning unit at a predetermined timing. The controller controls the feeding device such that, when the equipment is left unused, the feeding means effects postcleaning by feeding the liquid developer from the tank to the developing unit and cleaning unit at a predetermined timing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
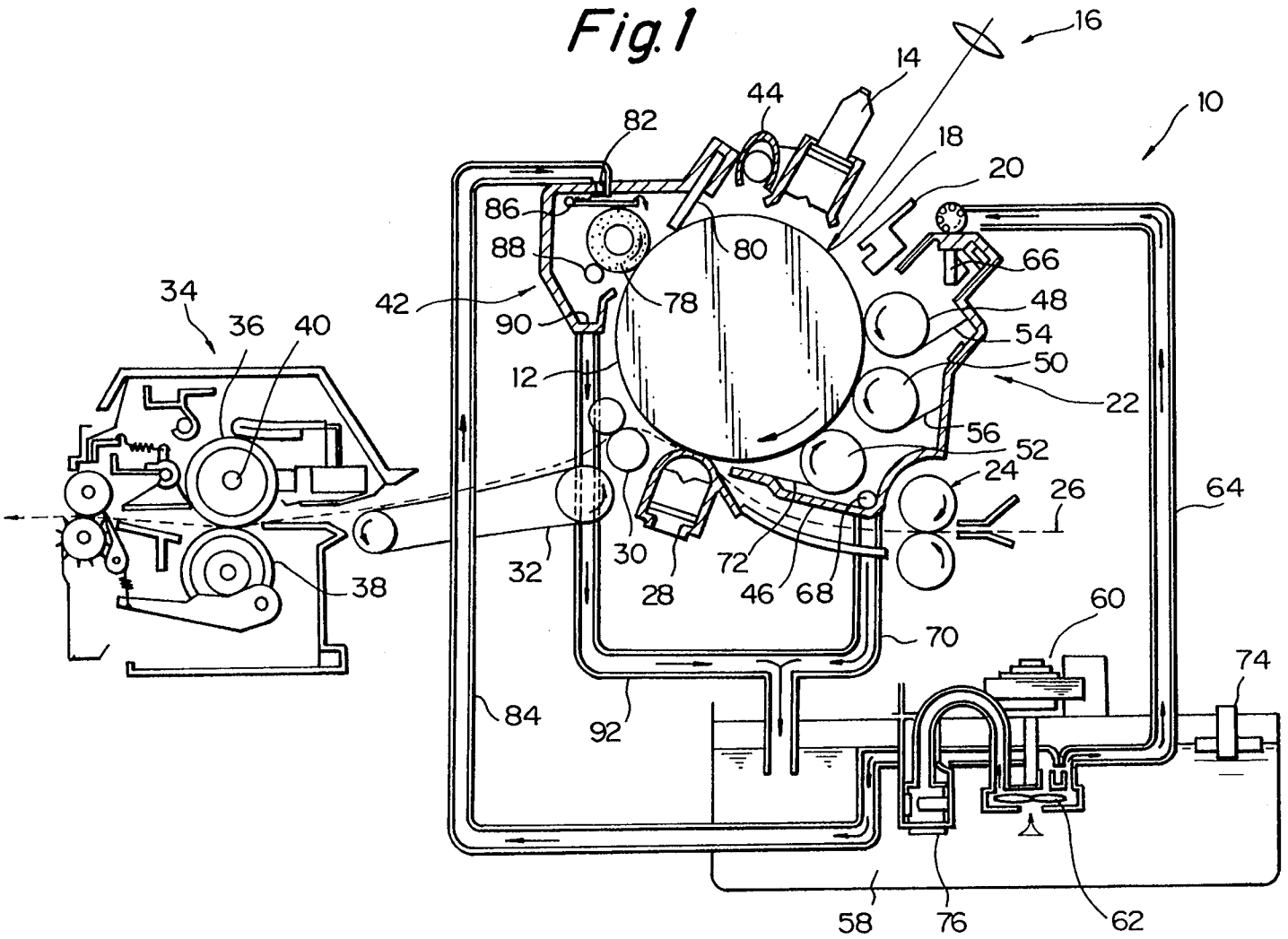
FIG. 1 is a section of an electrophotographic copier embodying the present invention.

Referring to FIG. 1 of the drawings, an electrophotographic copier embodying the present invention is shown and generally designated by the reference numeral 10. As shown, the copier 10 has a photoconductive element 12 which serves as an image carrier and is implemented as a drum by way of example. While the drum 12 is rotated in a direction indicated by an arrow in the figure, a main charger 14 uniformly charges the surface of the drum 12. An exposing device 16 focuses light representative of a document image onto the charged surface of the drum 12 at an exposing position 18, whereby a latent image is electrostatically formed on the drum 12. An eraser 20 dissipates the charge deposited in the areas of the drum 12 other than the image area. A developing device 22 develops the latent image of the drum 12 by a toner. The resulting toner image is transferred by a transfer charger 28 to a paper sheet 26 which is fed from a paper feeding device, not shown, by a transport roller pair 24. A separating roller pair 30 separates the paper sheet 26 carrying the toner image thereon from the drum 12. A transport belt 32 transports the paper sheet 26 separated from the drum 12 to a fixing device 34. The fixing device 34 has a heat roller 36 accommodating a heater 40 therein, and a pressure roller 38. While the paper sheet 26 is driven through the nip portion between the rollers 36 and 38, the toner image is fixed on the paper sheets 26. Then, the paper sheet or copy 26 is driven out of the copier 10 to a tray, not shown. A cleaning device 42 removes toner particles remaining on the drum 12 after the paper sheet 26 has been separated from the drum 12, and then a discharging unit 44 dissipates the remaining charge from the drum 12 to prepare the drum 12 for the next copying cycle. The discharging unit 44 may be implemented with a lamp or a discharger.

The developing device 22 has a casing 46 which accommodates therein a first developing roller 48, a second developing roller 50, and a squeeze roller or reverse roller 52. The first and second developing rollers 48 and 50 each is spaced apart from the surface of the drum 12 by a gap which is as small as 0.1 millimeter. Driven by a driving device, not shown, the developing rollers 48 and 50 rotate in the opposite direction to the drum 12 and at a peripheral speed higher than that of the drum 12. Scrapers 54 and 56 also located in and affixed to the casing 46 contact respectively the developing rollers 48 and 50 to constantly remove the toner from the latter. A liquid developer is fed from a developer tank 58 to the developing device 22. Specifically, a pump 62 is driven by a motor 60 to feed a liquid developer from the developer tank 58 to the developing device 22 via a feed conduit 64. The developing rollers 48 and 50 and scrapers 54 and 56 convey the liquid developer uniformly to the surface of the drum 12. After the liquid developer has developed the latent image on the drum 12 while flowing between the drum 12 and the rollers 48 and 50, it is returned to the developer tank 58 via an opening 68 and a return conduit 70. The reverse roller 52 is rotated in the opposite direction to the drum 12 by a driving device, not shown to squeeze off the excessive liquid developer from the drum 12. A scraper 72 scrapes off the liquid developer collected by the reverse roller 52. A float switch 74 is responsive to the liquid level in the developer tank 58, while a toner sensor 76 is responsive to the concentration of toner in the liquid developer in the tank 58. Specifically, the toner sensor 76 senses the toner concentration of the liquid developer which sequentially decreases due to the repetitive copying cycle. When the toner concentration decreases below a predetermined value, a toner is fed to the liquid developer to maintain the toner concentration in a predetermined range.

The cleaning device 42 has cleaning roller 78 and a cleaning blade 80. The cleaning roller 78 and cleaning blade 80 are made of a foaming material and an elastic material such as rubber, respectively. The liquid developer in the tank 58 is also fed to the cleaning device 42 via a feed conduit 84 and a nozzle 82 which is located above the device 42. In the cleaning device 42, the liquid developer is distributed over the entire width of the cleaning roller or sponge roller 78 by a plate 86 which is disposed below the nozzle 82. The toner and paper dust removed from the drum 12 is squeezed off by a squeeze roller 88 together with the liquid and then returned to the tank 58 via an opening 90 formed through the bottom of the cleaning device 42 and a return conduit 92.

Figure 2:
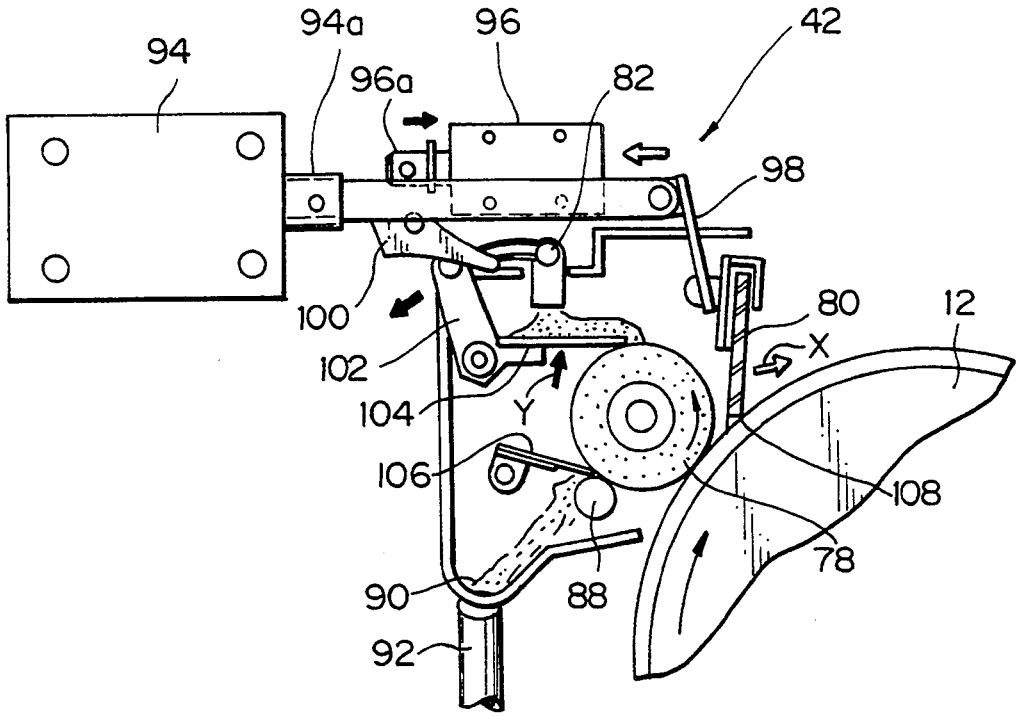
FIG. 2 is a section showing a specific construction of a cleaning device included in the illustrative embodiment.

FIG. 2 shows a specific construction of the cleaning device 42. As shown, the cleaning device 42 has solenoids 94 and 96 for actuating the cleaning blade 80 and sponge roller 78, respectively. The solenoid 94 has a plunger **94*a* connected to one end of a rotatable lever 98 which carries the cleaning blade 80 at the other end thereof. As the solenoid actuates the lever 98, the cleaning blade 80 is moved into and out of contact with the surface of the drum 12. A blank arrow X indicates the direction for causing the cleaning blade 80 into contact with the drum 12. On the other hand, the solenoid 96 has a plunger 96*a* which is operatively connected to a rotatable lever 100. The solenoid 96 moves the plate 104 into and out of contact with the sponge roller 78 via the plunger 96***a* and rotatable lever 100 and a rotatable lever 102 to which a distributing plate 104 is affixed. An arrow Y indicates the direction for moving the distributing plate 104 away from the sponge roller 78. A scraper 106 is held in contact with the squeeze roller 88 to remove the toner from the latter at all times.

One of characteristic features of the illustrative embodiment is that the carrier of the liquid developer is implemented with a sparingly volatile solvent having a siloxane structure, e.g. polymethylphenyl siloxane. Hence, although some liquid developer 108, FIG. 2, remains between the cleaning blade 80 and the drum 12 after the former has been moved away from the latter, the toner is prevented from drying immediately and adhering to the drum 12 due to the low volatility even when the liquid 108 is left there over a long period of time. Specifically, experiments showed that when the copier 10 is operated after a long time of suspension, the liquid developer 108 will be substantially fully removed from the drum 12 only if the cleaning operation is effected once, i.e. , if the drum 12 is rotated only once with the sponge roller 78 and cleaning blade 80 abutting thereagainst. The experiments were conducted by use of a carrier constituted by polymethylphenyl siloxane only, a carrier consisting of 25 Vol % of polymethylphenyl siloxane and 75 Vol % of Isopar H, and a carrier consisting of 50 Vol % of polymethylphenyl siloxane and 50 Vol % of Isopar H. For comparison, experiments were also conducted by use of carriers which are not sparingly volatile and lack the siloxane structure, i.e. Isopar G, Isopar H, and Isopar L. When such comparative carriers were used, the toner contained in the liquid developer 108 was dried and caused to adhere to the surface of the drum 10 and was not removed until the cleaning operation was repeated about thirty times, i.e. , until the drum 12 was rotated at least thirty consecutive times with the sponge roller 78 and cleaning blade 80 abutting thereagainst. The carriers used for the experiments each contained 100 grams per litter of toner which is used with a copier "CT-5085" of RICOH CO, LTD. The copier was run 5,000 times, left without any operation for one week, and then operated to determine the number of times that the drum 12 is rotated until the liquid developer 108 has been fully removed from the drum 12. When use is not made of a carrier having the siloxane structure, as has been customary, a copying operation to be effected after a long time of suspension has to be preceded by precleaning since the liquid developer 108 remaining on the drum 12 sticks to the drum 12. This, coupled with the fact that the drum 12 has to be rotated thirty times during precleaning, increases the waiting time and thereby delays the beginning of the actual copying operation.

Figure 3:
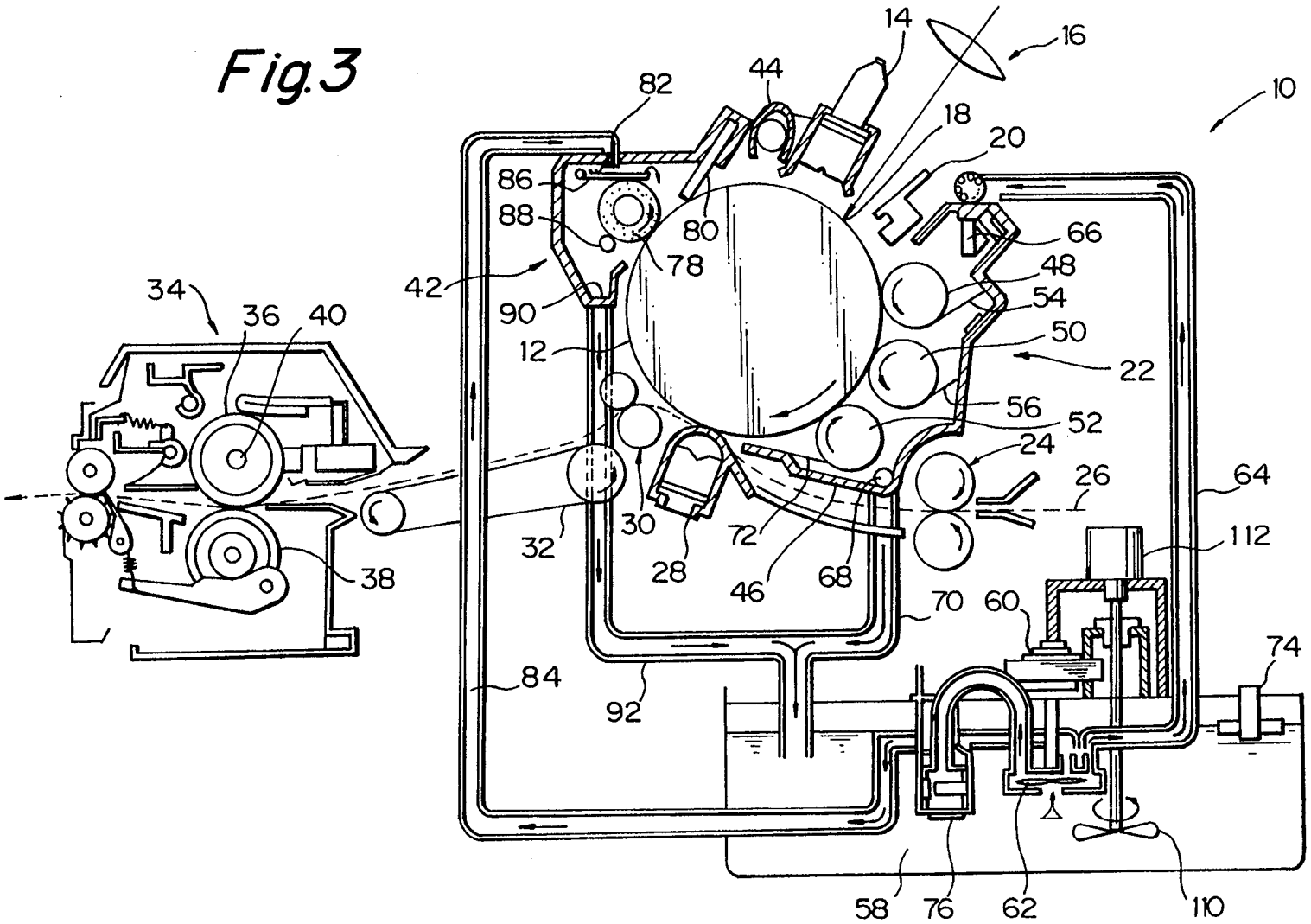
FIG. 3 is a section showing a specific construction of a stirring device for stirring a liquid developer stored in a developer tank also included in the embodiment.

The illustrative embodiment using a dispersion of a toner in a carrier having the siloxane structure prevents the toner from easily adhering to the drum 12, as stated above. Nevertheless, when the copier is not used over a long period of time, the liquid developer stored in the developer tank 58, for example, causes the dispersed state of the toner in the carrier to degrade and lowers the quality of the toner image developed thereby. A prerequisite is, therefore, that the liquid in the developer tank 58 be stirred to maintain the toner in a desirable dispersed state in the carrier. This has not been an issue in the past since it has been customary to stir a liquid developer during precleaning. The illustrative embodiment periodically stirs the liquid in the tank 58 while the copier is not operated over a long period of time. Specifically, the embodiment stirs the liquid in the tank 58 every time 15 minutes expires without any copying operations after the stop of rotation of the drum 12 and the stop of operation of the pump 62. As shown in FIG. 3 specifically, a blade 110 is disposed in the liquid in the tank 58 and driven by a motor 112 to stir the liquid. Of course, the role of the blade 110 may be played by the pump 62 which is driven by the motor 60. If desired, an exclusive motor other than the motor 60 may be used for operating the pump 62 at the time of stirring. Periodically stirring the liquid in the tank 58 as stated above is successful in maintaining the toner in a desirable dispersed state in the carrier even when the copier is not used over a long period of time. Of course, the illustrative embodiment maintains the copier in an operable state at all times even during such suspensions.

The liquid developer in the developer tank 58 is fed by the pump 62 to the developing device 22 and cleaning device 42, i.e. , the developing rollers 48 and 50, reverse roller 52, and sponge roller 78 via the conduits 64 and 84, respectively, as stated earlier. Although most of the liquid developer remaining on such rollers after copying operations is removed by the associated scrapers 54, 56 and 72 and squeeze roller 88, some still remains. Also, some liquid developer remains in the developing device 22 and cleaning device 42. Such a part of the liquid, like the liquid in the tank 58, will degrade the dispersed state of the toner in the carrier when the copier is not operated over a long period of time. This degraded liquid would affect the subsequent developing and cleaning operations. Of course, the conventional liquid developer lacking low volatility and siloxane structure would cause the toner thereof to adhere to the individual rollers in the developing and cleaning devices and to dry and deposit within the devices. In the light of the above, this embodiment not only periodically stirs the liquid in the tank 58 but also periodically feeds the liquid from the tank 58 to the developing device 22 and cleaning device 42. This periodic feed of the liquid to the devices 22 and 42, i.e. , postcleaning as will be referred to hereinafter frees the liquid remaining on the individual rollers and inside the individual devices from degradation. Specifically, when a predetermined period of time expires after the turn-on of the power source of the copier or when the copier is not used for a long period of time, the embodiment effects postcleaning every time 2 hours lapses.

Figure 4:
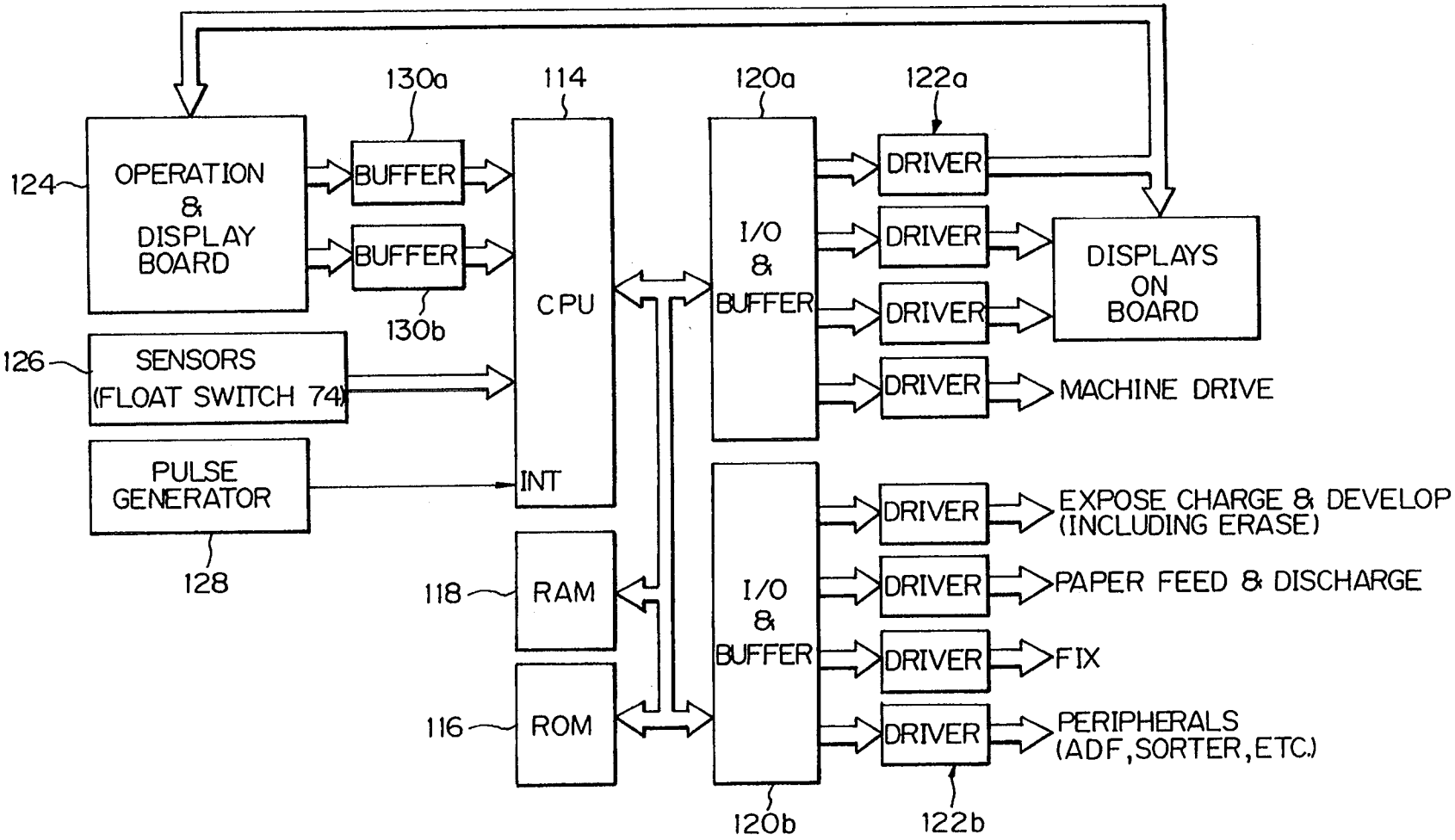
FIG. 4 is a block diagram schematically showing a control system of the embodiment.
Figure 5:
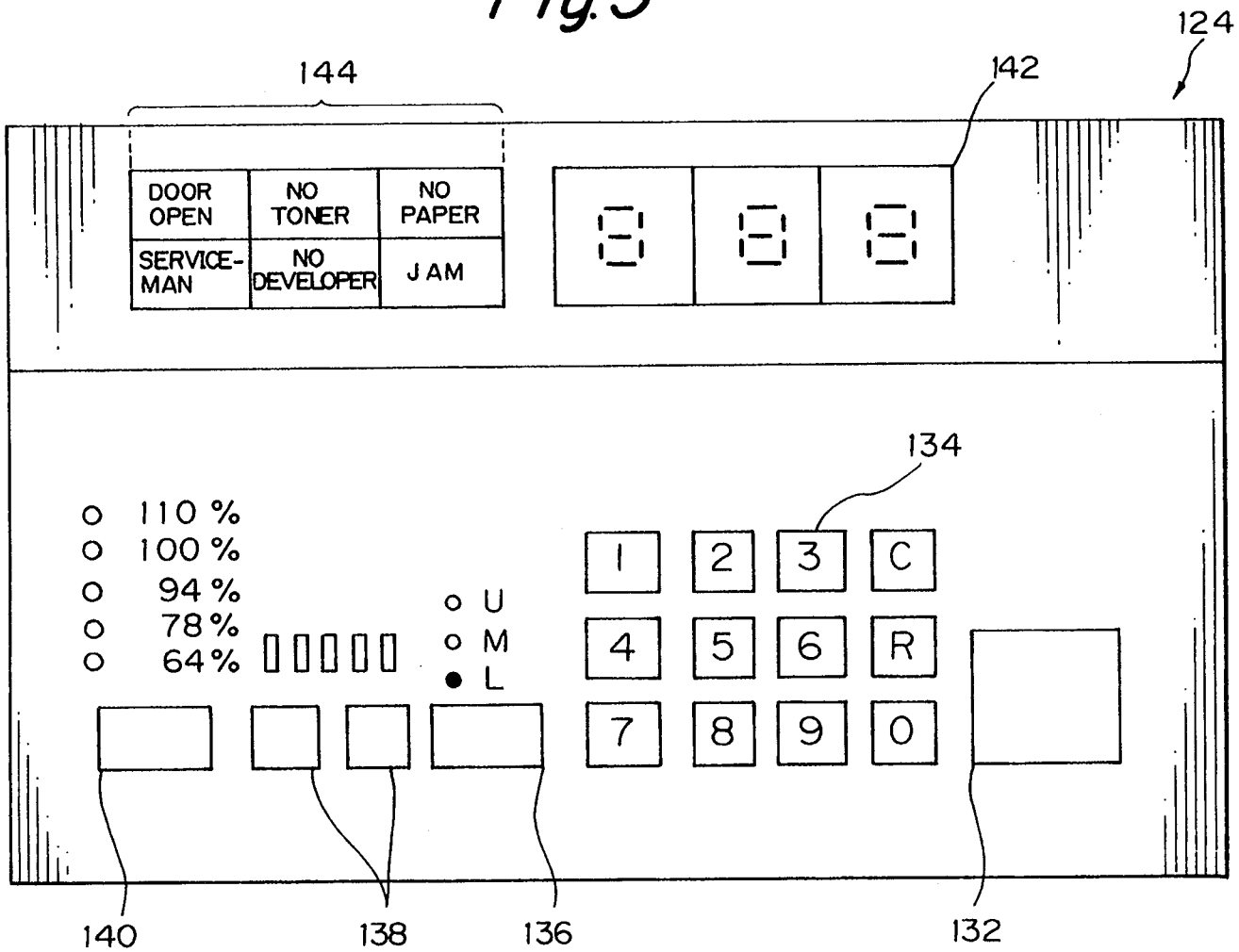
FIG. 5 is a plan view showing a specific arrangement of an operation and display board included in the system of FIG. 4.

Referring to FIG. 4, a control system of the illustrative embodiment is shown. As shown, the control system has a CPU 114 and a ROM 116, a RAM 118 and an input/output (I/O) port buffers 120*a* and 120*b* which are connected to the address buss, control bus and data bus of the CPU 114. Drivers 122*a* and drivers 122*b* are respectively connected to the I/O port buffers 120*a* and 120*b* for selectively driving their associated loads such as drives and displays. The reference numeral 124 designates an operation and display board. State sensors 126 are responsive to the states of various sections inside the copier and include the float switch 74. A pulse generator 128 generates pulses in synchronism with the rotation of the drum 12. Buffers 130*a* and 130*b* feed the output signals of the operation and display board 124 to the CPU 114. A specific layout of keys and displays on the operation and display board 124 is shown in FIG. 5. In FIG. 5, there are shown a print key 132 for starting a copying operation, numeral keys 134, a cassette select key 136, an exposure select key 138, a magnification select key 140, a 3-figure copy number display 142, and an alarm display 144.

Figure 6:
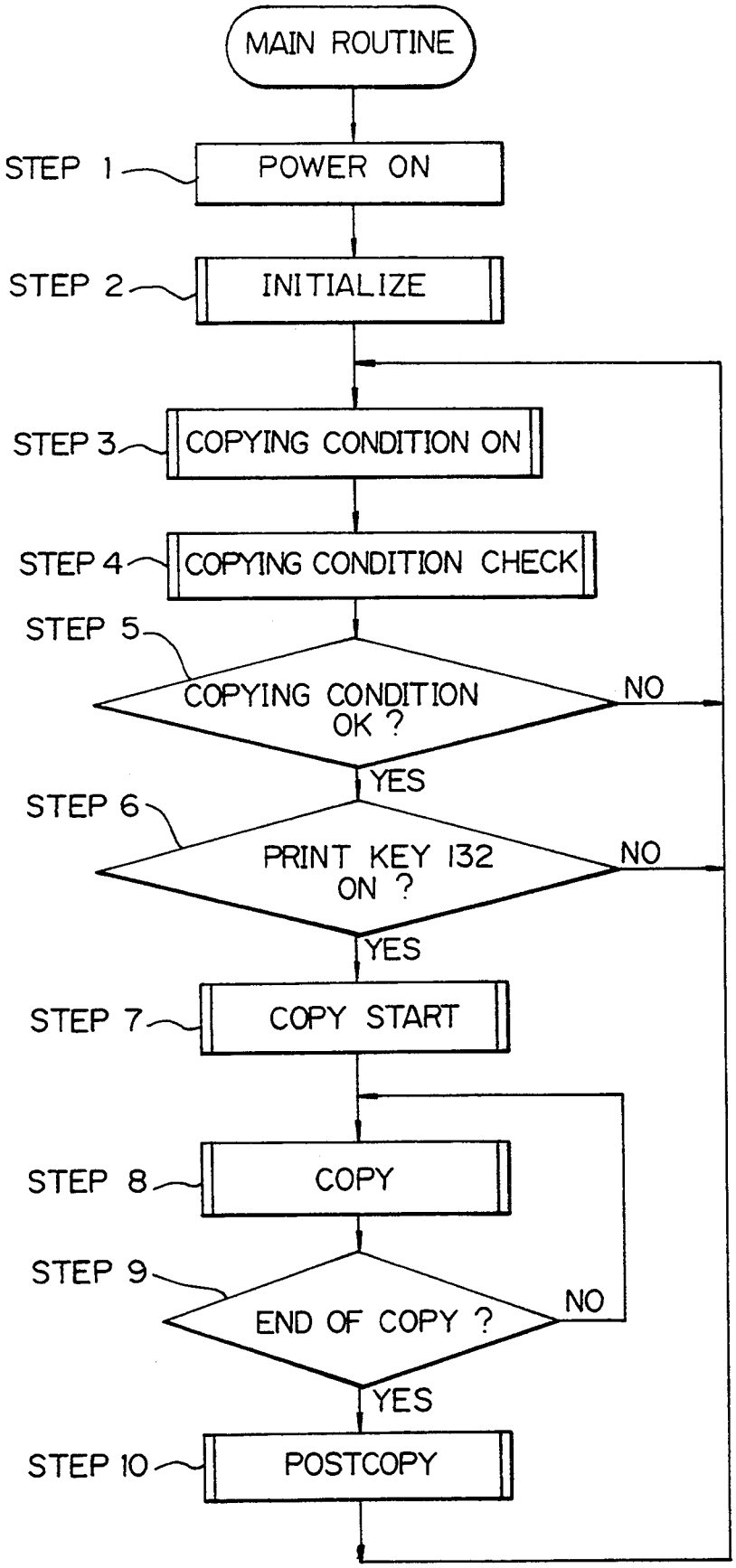
FIGS. 6, 7, 8, 9, 10, and 11 are flowcharts demonstrating specific operations of the system shown in FIG. 4.

FIG. 6 shows a specific operation or main routine of the CPU 114, FIG. 4, particularly the control procedure associated with the cleaning operation described above. When the power source is turned on (STEP 1), the CPU 114 initializes the copy modes including the setting of the heater 40 of the fixing device 34, set copy number, and magnification (STEP 2). After the operator has entered desired copying conditions on the operation and display board 124 (STEP 3), the CPU 114 determines whether or not various copying conditions including the warm-up of the heater 40 are acceptable (STEP 5) and then awaits the operation of the print key 132.

Figure 7:
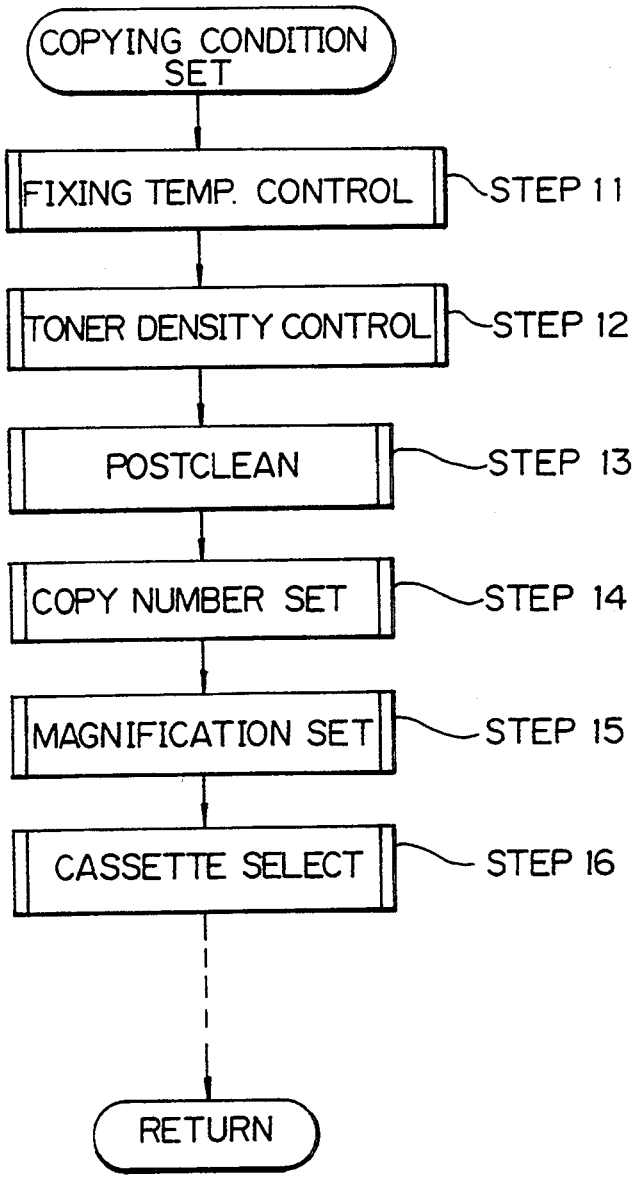
Figure 8:
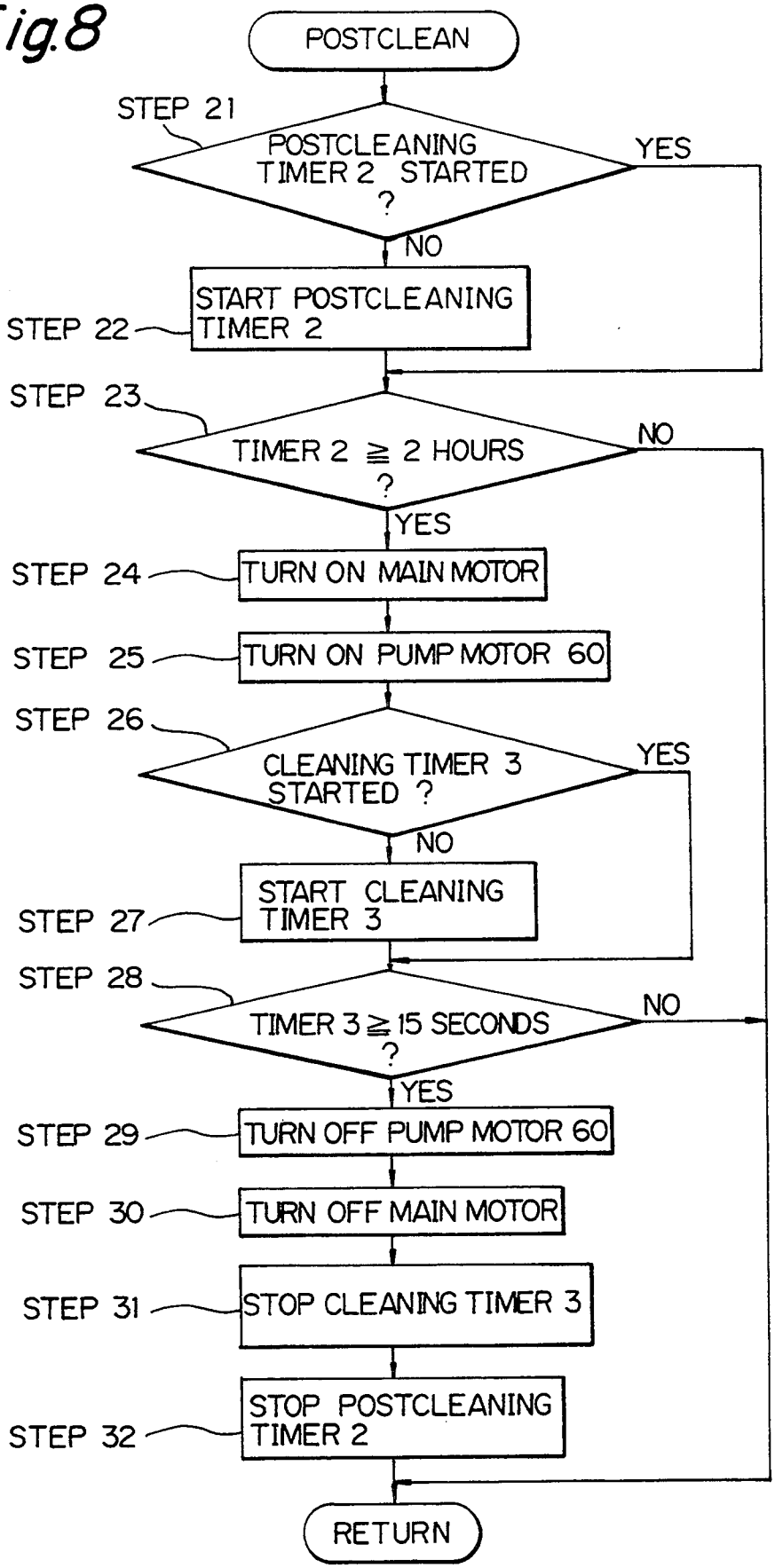

FIG. 7 shows the copy condition set procedure (STEP 3) specifically. As shown, this procedure is made up of copy condition setting (STEP 12), fixing temperature control (STEP 11), toner concentration control (STEP 12), postcleaning (STEP 13), copy number setting (STEP 14), magnification setting (STEP 15), cassette selecting (STEP 16), and other subroutines. The postcleaning subroutine (STEP 13) is shown in FIG. 8 specifically. This subroutine begins with STEPs 21 and 22 for starting a postcleaning timer 2. When the post cleaning timer 2 counts a predetermined time (2 hours in the embodiment) (STEP 23), the CPU 114 energizes the main motor (STEP 24), energizes the motor 60 assigned to the pump 62 (STEP 25), and starts a cleaning timer 3 (STEPs 26 and 27). As the timer 3 counts a predetermined time (15 seconds in the embodiment) (STEP 28), the CPU 114 deenergizes the motor 60 (STEP 29) and deenergizes main motor (STEP 30). Specifically, on the lapse of 2 hours after the start of the postcleaning timer 2, the liquid developer is fed from the tank 58 to the developing device 22 and cleaning device 42 for 15 minutes, and then the pump motor 60 and main motor are turned off. Thereafter, the cleaning timer 3 and postcleaning timer 2 are stopped (STEPs 31 and 32).

Figure 9:
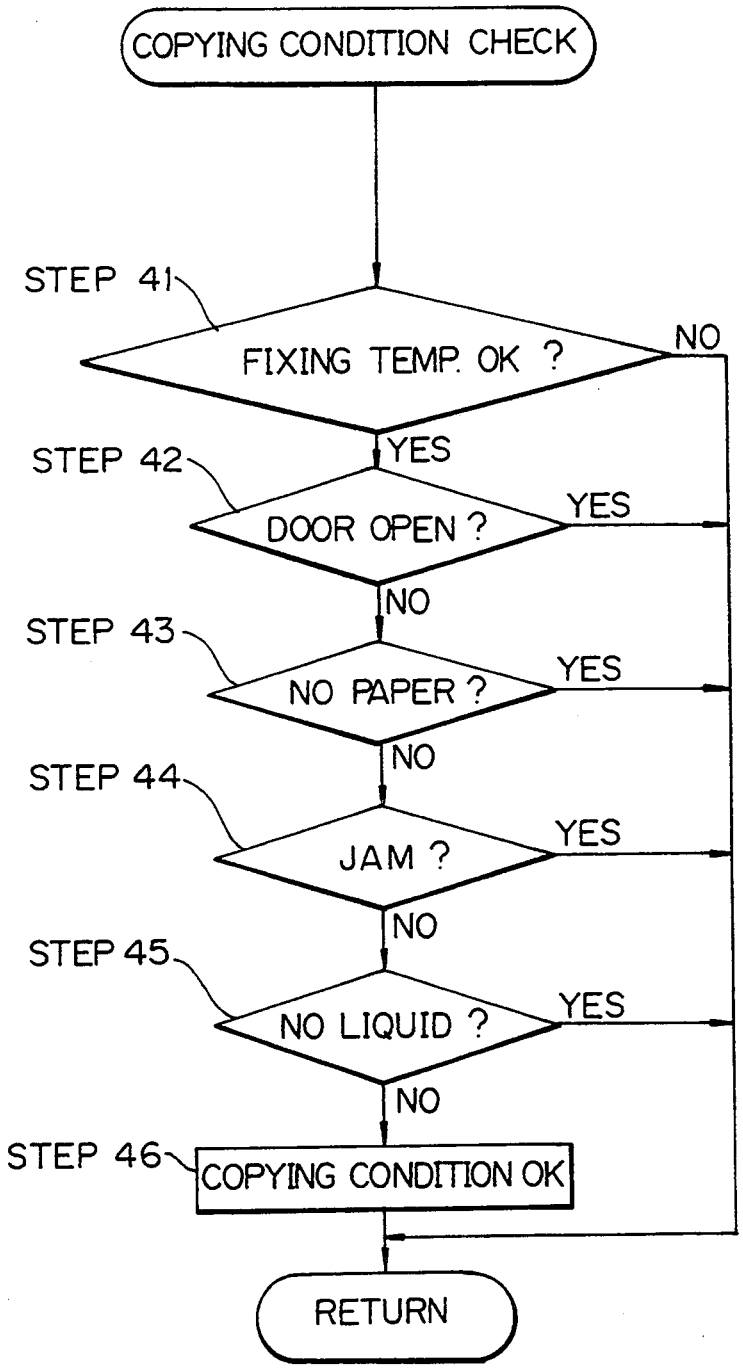
Figure 10:
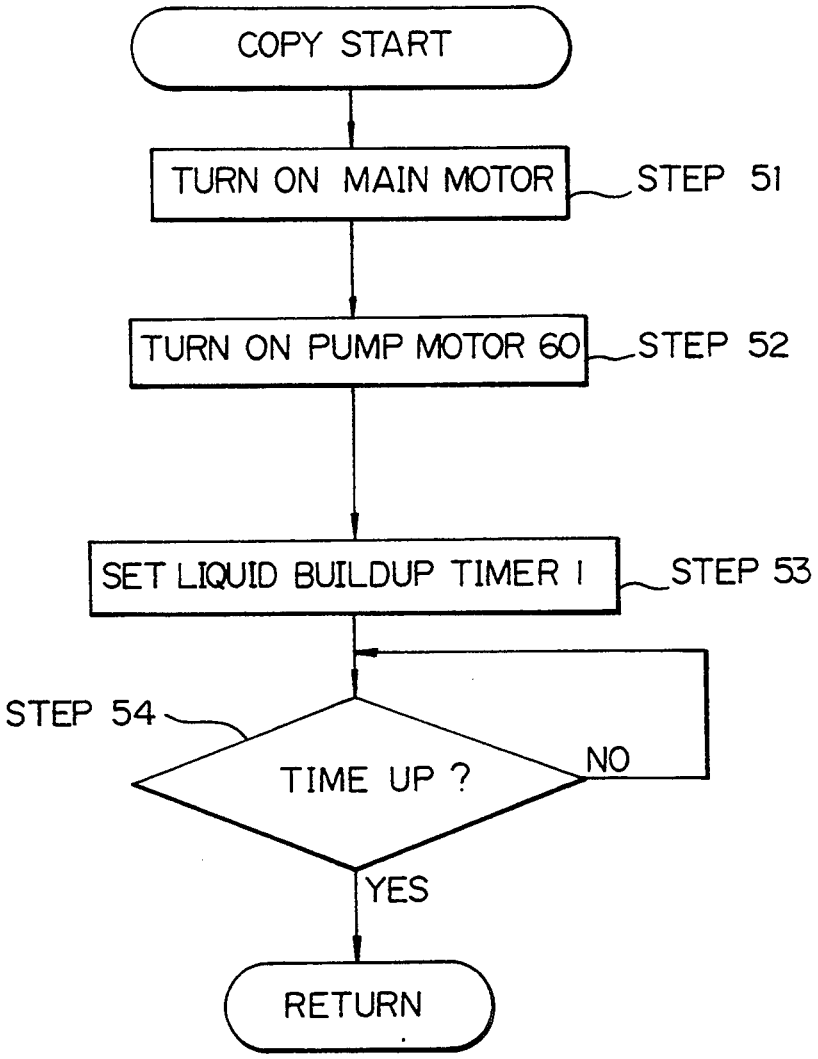

The copying condition check procedure (STEP 4) of FIG. 6 is shown in FIG. 9 in detail. First, whether the fixing temperature has reached a predetermined value or not is determined (STEP 41). If the answer of the STEP 41 is YES, the CPU 114 checks the door of the copier 10 to see if it is open (STEP 42) and, if it is closed, determines whether or not the paper sheets are short (STEP 43). If the answer of the STEP 43 is NO, the CPU 114 determines whether or not any paper sheet has jammed the copier (STEP 44) and, if the answer is NO, determined whether or not the liquid developer is short (STEP 45). If the answer of the STEP 45 is NO, the CPU 114 writes information representative of "READY" in a register (STEP 46) and then returns to the main routine, FIG. 6. If the answer of any one of such a sequence of steps is YES, the program returns to the main routine, FIG. 6, after clearing the READY information.

Referring again to FIG. 6, when the print key 132 is pressed (STEP 6) under the READY condition (STEP 5), the program advances to the copy start procedure (STEP 7). In this procedure, the CPU 114 turns on the main motor (STEP 51) to rotate the drum 12. Then, the CPU 114 drives the pump motor 60 (STEP 52) to start feeding the liquid developer from the tank 58 to the developing device 22 and cleaning device 42. The CPU 114 sets a time in which the developing device 22 will be filled with the liquid developer after the turn-on of the motor 60 in the timer (program timer) 1 and then starts it (STEP 53). When the time set in the timer 1 expires, the program advances to the copy procedure (STEP 8), FIG. 6.

In the copy procedure (STEP 8), the CPU 114 sequentially controls the exposing lamp, charger and other image forming units and the copying process including paper feed, paper transfer and image transfer, while counting output pulses of the pulse generator 128, FIG. 4. After the copying cycle has completed once, the CPU 114 determines whether or not the set number of copies have been produced (STEP 9). If the answer of the STEP 9 is NO, the CPU 114 does not set an end flag and returns to the copy procedure (STEP 8) for repeating the copying cycle. After the repetitive copying operation, the CPU 114 executes the postcopy procedure (STEP 10).

Figure 11:
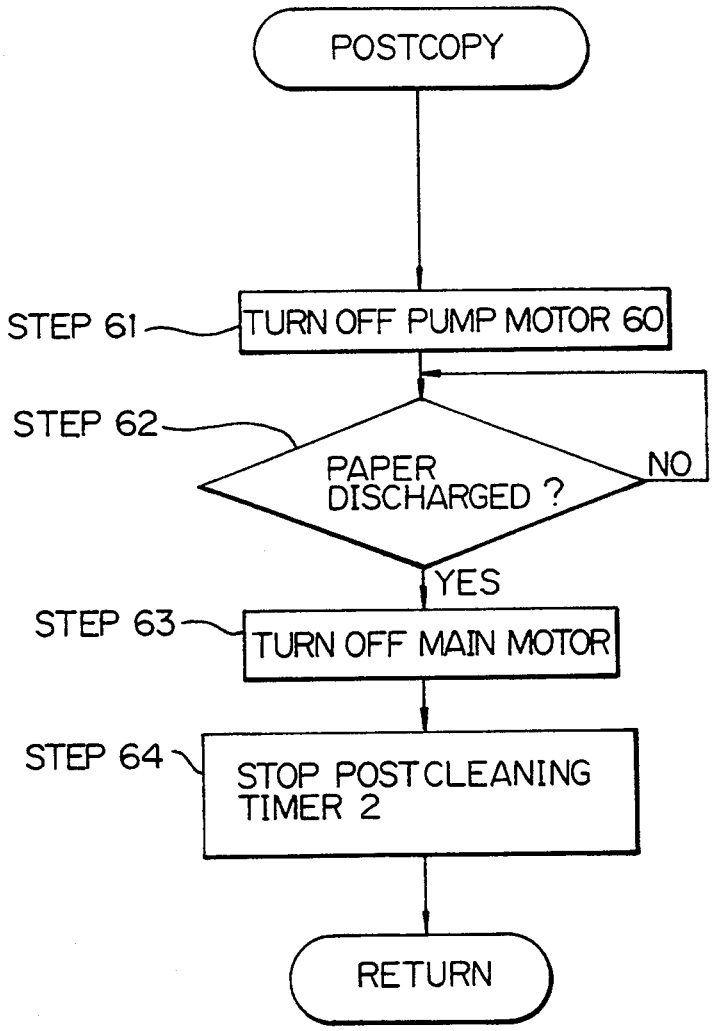

FIG. 11 shows the postcopy procedure (STEP 10) specifically. As shown, the CPU 114 deenergizes the pump motor 60 (STEP 61), waits until a paper sheet has been driven out of the copier (STEP 62), deenergizes the main motor (STEP 63) after the discharge of the paper sheet, resets the cleaning timer 2 (STEP 64), and then returns to the main routine, FIG. 6.

In FIG. 6, the postcopy processing (STEP 10) is followed by the copy condition set processing (STEP 3). Thereafter, the iterative loop of STEPs 3, 4, 6, 7, 8, 9 and 10 is executed.

When the power source of the copier 10 is turned on, the postcleaning procedure (STEP 13) shown in FIGS. 7 and 8 and included in the copy condition setting (STEP 3), FIG. 6, is executed. Then, the CPU 114 starts the postcleaning timer 2. As 2 hours expires without any copying operation being effected, the CPU 114 executes postcleaning (STEPs 24 to 32, FIG. 8) for 15 minutes. When the postcleaning timer 2 is turned off at the STEP 32, the program is transferred from the postclean procedure (STEP 13) to the STEP 14 and successive steps of the subroutine (copy condition setting, STEP 3) of FIG. 7, then to the copy condition check procedure (STEP 4, FIG. 6), then to the STEPS 5 and 6, and then to the copy condition set procedure (STEP 3). As soon as the CPU 114 reaches the postclean procedure (STEP 13) included in the STEP 3, it starts the postcleaning timer 2 again (STEPS 21 and 22, FIG. 8). As a result, assuming that the copier 10 has not been started after the turn-on of the power source, the postclean procedure is executed every 2 hours (STEPs 24 to 32, FIG. 8). Assuming that the copier has been started, the CPU 114 turns off the postclean timer 2 (STEP 64, FIG. 11) as the program proceeds to the postcopy procedure (STEP 10) after the copying operation. Therefore, when a copying operation is performed, the CPU 114 causes the postcleaning timer 2 to start counting 2 hours anew on the completion of the copying operation. It follows that when a copying operation is effected, postcleaning (STEPs 24 to 32, FIG. 8) will be executed when 2 hours expires without any copy start after the end of the copying operation.

In summary, it will be seen that the present invention provides an electrophotographic copier which insures desirable image quality even when left unused over a long period of time. Specifically, in such a period, the copier not only periodically stirs a liquid developer stored in a developer tank thereof but also periodically feeds the liquid to a developing device and a cleaning device to effect postcleaning, thereby maintaining a toner contained in the liquid in a good dispersed condition in a carrier and preventing it from depositing or adhering to rollers included in the cleaning device. Further, the present invention eliminates the need for preheating and precleaning heretofore effected after and before a copying operation, respectively. This allows the copier to start on an operation immediately and thereby reduces the waiting time.

While the present invention has been shown and described in relation to an electrophotographic copier, it is similarly applicable to a facsimile transceiver, printer or similar image forming equipment having a developing device of the type using a liquid developer.

Various modifications will become possible for those skilled in the art after receiving the teachings of the present disclosure without departing from the scope thereof.

What is claimed is:

1. An image forming equipment comprising:

an image carrier for electrostatically forming a latent image on a surface thereof by exposure;

a developing unit for developing the latent image by a liquid developer stored in a tank to produce a visible image;

an image transferring unit for transferring the visible image to a recording medium;

a movable cleaning unit for cleaning the surface of the image carrier after image transfer;

the liquid developer comprises a mixture of a toner and a liquid carrier;

wherein said liquid carrier consist essentially of poly-methyl phenyl siloxane having a low volatility;

a print command switch which is continuously held in a printable state after the turn-on of a power source;

means for causing said cleaning unit to perform a cleaning operation upon the turn-on of the print command switch;

stirring means coupled to said tank for periodically stirring said liquid developer contained therein, and means for, after the cleaning unit has cleaned a leading edge of an image on the image carrier once, to commence a recording operation which begins when the exposure is started.

2. Equipment as claimed in claim 1, wherein said stirring means is constructed integrally with a feeding means.

3. An image forming equipment as in claim 1 wherein:

said liquid carrier consists of 25% volume to 100% volume of poly-methyl phenyl siloxane.

4. A device as claimed in claim 1 further comprising:

a control means coupled to said stirring means for activating said stirring means at a predetermined interval when said equipment is left unused.

5. Equipment as claimed in claim 4, wherein said predetermining interval is such that said stirring means stirs said liquid developer for 30 seconds every time 15 minutes expires.

6. A device as in claim 1 further comprising:

a control means coupled to said feeding means for activating said feeding means so as to effect a post cleaning operation by feeding liquid developer to said developing unit and said cleaning unit at a predetermined time when the equipment is left unused.

7. Equipment as claimed in claim 6, wherein said predetermined timing is such that said postcleaning is effected for 15 minutes every time 2 hours expires.

* * * * *